US010821472B2

(12) United States Patent
Koike et al.

(10) Patent No.: US 10,821,472 B2
(45) Date of Patent: Nov. 3, 2020

(54) COATING PRETREATMENT FACILITY

(71) Applicant: Taikisha Ltd., Tokyo (JP)

(72) Inventors: Toshihiko Koike, Tokyo (JP); Yasuhiko Sakota, Tokyo (JP); Yoshikazu Hayashi, Tokyo (JP)

(73) Assignee: Taikisha Ltd., Tokyo (JP)

( * ) Notice: Subject to any disclaimer, the term of this patent is extended or adjusted under 35 U.S.C. 154(b) by 94 days.

(21) Appl. No.: 16/308,501

(22) PCT Filed: Apr. 28, 2017

(86) PCT No.: PCT/JP2017/016986
§ 371 (c)(1),
(2) Date: Dec. 10, 2018

(87) PCT Pub. No.: WO2018/003279
PCT Pub. Date: Jan. 4, 2018

(65) Prior Publication Data

US 2019/0193107 A1 Jun. 27, 2019

(30) Foreign Application Priority Data

Jun. 28, 2016 (JP) ..... 2016-127407

(51) Int. Cl.
*B05C 21/00* (2006.01)
*B05D 3/00* (2006.01)
(Continued)

(52) U.S. Cl.
CPC ..... *B05C 21/00* (2013.01); *B05D 3/002* (2013.01); *B05D 3/102* (2013.01); *B05D 3/104* (2013.01);
(Continued)

(58) Field of Classification Search
CPC ..... B05C 21/00; B05D 3/002; B05D 3/102; B05D 3/104; B05D 3/12; B08B 3/022;
(Continued)

(56) References Cited

U.S. PATENT DOCUMENTS 6,090,254 A 7/2000 Sobata et al.
8,636,018 B2 1/2014 Kozuka et al.
2012/0312324 A1* 12/2012 Kozuka ..... B08B 3/08 134/10

FOREIGN PATENT DOCUMENTS

CN 103008268 A 4/2013
CN 104668165 A 6/2015
(Continued)

*Primary Examiner* — Levon J Shahinian
(74) *Attorney, Agent, or Firm* — The Webb Law Firm

(57) ABSTRACT

In a coating pretreatment facility using microbubbles, an arrangement is made to make it possible to form the facility compact and to reduce the initial cost and the running cost of the facility. A preliminary cleansing water supplying passage 33 is provided for supplying cleansing waters W1, W2 used in cleansing of a coating subject article B in flushing sections 3, 4 following a degreasing section 2 as preliminary cleansing water W3 for use in preliminary cleansing of the coating subject article B in a preliminary cleansing section 1. A microbubble generator device 34 is provided for causing the preliminary cleansing water W3 used in the preliminary cleansing of the coating subject article B in the preliminary cleansing section 1 to contain microbubbles.

7 Claims, 5 Drawing Sheets

(51) Int. Cl.

| | |
|---|---|
| ***B05D 3/10*** | (2006.01) |
| ***B05D 3/12*** | (2006.01) |
| ***B08B 3/02*** | (2006.01) |
| ***B08B 3/04*** | (2006.01) |
| ***B08B 3/08*** | (2006.01) |
| ***C23G 5/00*** | (2006.01) |
| ***C23G 5/04*** | (2006.01) |

(52) U.S. Cl.
CPC ..... *B05D 3/12* (2013.01); *B08B 3/022* (2013.01); *B08B 3/041* (2013.01); *B08B 3/08* (2013.01); *C23G 5/00* (2013.01); *C23G 5/04* (2013.01)

(58) Field of Classification Search
CPC .. B08B 3/041; B08B 3/08; C23G 5/00; C23G 5/04
USPC ..... 134/61, 123
See application file for complete search history.

(56) References Cited

FOREIGN PATENT DOCUMENTS

| | | | |
|---|---|---|---|
| JP | 8291395 | A | 11/1996 |
| JP | 3047357 | U | 1/1998 |
| JP | 2011173086 | A | 9/2011 |
| JP | 2013248564 | A | 12/2013 |
| JP | 201649509 | A | 4/2016 |

* cited by examiner

COATING PRETREATMENT FACILITY

CROSS-REFERENCE TO RELATED APPLICATIONS

This application is the United States national phase of International Application No. PCT/JP2017/016986 filed Apr. 28, 2017, and claims priority to Japanese Patent Application No. 2016-127407 filed Jun. 28, 2016, the disclosures of which are hereby incorporated in their entirety by reference.

TECHNICAL FIELD

This disclosure relates to a coating pretreatment facility for treating a coating subject article prior to its coating.

More particularly, this disclosure relates to a coating pretreatment facility including a preliminary cleansing section for preliminarily cleansing a coating subject article prior to its coating with preliminary cleansing water, a degreasing section for effecting a chemical degreasing treatment on the coating subject article preliminarily cleansed by the preliminary cleansing section with degreasing agent solution, and a flushing section for flushing the coating subject article degreased by the degreasing section with cleansing water.

BACKGROUND ART

Conventionally, with this type of coating pretreatment facility, as shown in Patent Documents 1-3 identified below, for enhancing the treatment effect of the degreasing treatment on the coating subject article prior to its coating with use of microbubbles, a microbubble generator device is arranged to supply microbubbles to the degreasing agent solution held in a degreasing tank in which the coating subject article is to be submerged (dipped).

Namely, by introducing microbubbles to the degreasing agent solution in the degreasing tank, with impulse (shock) waves discharged at time of bursting of the microbubbles, the treatment effect of the degreasing treatment on the coating subject article submerged in the solution (the effect of removing oil adhering to the surface of the coating subject article) is enhanced.

BACKGROUND ART DOCUMENTS

Patent Documents

Patent Document 1: Japanese Unexamined Patent Application Publication No. 2011-173086

Patent Document 2: Japanese Unexamined Patent Application Publication No. 2013-248564

Patent Document 3: Japanese Unexamined Patent Application Publication No. 2016-49509

SUMMARY

Object to be Achieved by Invention

With the conventional facility arranged to supply microbubbles to degreasing agent solution in a degreasing tank, thanks to enhancement of the degreasing treatment effect, an effect of enhancing coating quality obtained by a subsequent coating on the coating subject article and an effect of increasing productivity of the coating subject article through reduction of a time period required for the degreasing treatment were obtained indeed. However, the facility has failed to achieve an effect of forming the facility compact and an effect of reducing the initial cost and the running cost of the facility.

In view of the above-described state of the art, the principal object of the present invention is to make it possible to achieve also the effect of forming the facility compact and the effect of reducing the initial cost and the running cost of the facility, while ensuring sufficient treatment effect of the degreasing treatment with implementation of a reasonable form of utilization of microbubbles.

Solution

A first characterizing feature of the present invention concerns a coating pretreatment facility, this coating pretreatment facility comprises:

a preliminary cleansing section for preliminarily cleansing a coating subject article prior to its coating with preliminary cleansing water;

a degreasing section for effecting a chemical degreasing treatment on the coating subject article preliminarily cleansed by the preliminary cleansing section with degreasing agent solution; and a flushing section for flushing the coating subject article degreased by the degreasing section with cleansing water;

wherein a preliminary cleansing water supplying passage is provided for supplying the cleansing water used in the flushing of the coating subject article in the flushing section to the preliminary cleansing section as the preliminary cleansing water for use in the preliminary cleansing in this preliminary cleansing section; and a microbubble generator device is provided for causing the preliminary cleansing water for use in the preliminary cleansing in the preliminary cleansing section to contain microbubbles.

Namely, to the flushing section following the degreasing section, a portion of the degreasing agent solution used in the degreasing treatment in the degreasing section is introduced as being adhering to the coating subject article moved from the degreasing section to the flushing section. Thus, the cleansing water used in the flushing of the coating subject article in the flushing section contains, though by a small amount, the degreasing agent solution (e.g. degreasing agent water solution having a degreasing agent concentration which is about 1/10 of that of the degreasing agent solution).

Therefore, by supplying, via the preliminary cleansing water supplying passage, the cleansing water used in the flushing of the coating subject article in the flushing section to the preliminary cleansing section as the preliminary cleansing water for use in the preliminary cleansing in this preliminary cleansing section, the preliminary cleansing of the coating subject article is preliminarily cleansed by the preliminary cleansing solution containing the degreasing agent solution.

Moreover, the preliminary cleansing water for use in the preliminary cleansing in the preliminary cleansing section is caused to contain microbubbles by the microbubble generator device. Therefore, in the preliminary cleansing section, the preliminary cleansing of the coating subject article is done by the preliminary cleansing solution which contains both the degreasing agent solution and the microbubbles.

With the above, in addition to the original preliminary cleansing treatment for removing dust such as iron dust adhering to the coating subject article from this article, the degreasing treatment for removing oil adhering to the article from this article can also be effected on the coating subject article with enhancement of its degreasing effect by means of the microbubbles.

And, since the degreasing treatment can be effectively done, in addition to the preliminary cleansing treatment, in the preliminary cleansing section with utilization of the degreasing agent solution contained in the cleansing water used in the flushing section (as it were, a "used degreasing agent solution"), an amount of oil carried into the degreasing section together with the coating subject article can be reduced, thereby to reduce the treatment load for the degreasing section. Consequently, the consumption amount of the degreasing agent solution can be reduced, thus reducing the running cost of the facility.

Further, in case the degreasing agent solution is to be maintained at a temperature suited for the degreasing treatment by means of heating, the heat energy required for such temperature maintaining of the degreasing agent solution can be reduced also. With this, further reduction in the running cost of the facility is made possible.

Moreover, thanks to the reduction in the treatment load for the degreasing section, the amount of oil to be removed from the coating subject article in the degreasing section is reduced as well. Thus, an oil removing device for separating and collecting removed oil from the degreasing agent solution can be small and the entire facility can be formed small correspondingly. Also, the initial cost and the running cost of the facility too can be further reduced.

Incidentally, in the preliminary cleansing section, in correspondence with the introduction thereto of the cleansing water used in the flushing section as the preliminary cleansing water, an amount of used preliminary cleansing water corresponding in its amount to the amount of the above introduction will be discharged from the preliminary cleansing section. Therefore, the oil removed from the coating subject article by the degreasing treatment in the preliminary cleansing section will not be accumulated in this preliminary cleansing section. Thus, there is no need to provide additionally an oil removing device in/for the preliminary cleansing section.

In summary, according to the inventive arrangement described above, it has become possible to achieve also the effect of forming the facility compact and the effect of reducing the initial cost and the running cost of the facility, while ensuring sufficient treatment effect of the degreasing treatment with implementation of a reasonable form of utilization of microbubbles.

A second characterizing feature of the invention specifies a preferred embodiment for embodying the first characterizing feature. According to this second characterizing feature:

the degreasing section includes only a dipping type main degreasing section for submerging (dipping) the coating subject article in the degreasing agent solution held in the degreasing tank; and the degreasing section precludes a preliminary degreasing section for effecting preliminary degreasing treatment on the coating subject article prior to the degreasing treatment at the dipping type main degreasing section.

As shown in Patent Document 3 described above, according to the conventional coating pretreatment facility (see FIG. 5), as a degreasing section 2, there are provided a dipping type main degreasing section 2B for effecting a degreasing treatment on a coating subject article B by submerging this article B in a degreasing agent solution L held in a degreasing tank 15 and a preliminary degreasing section 2A of e.g. spraying type for effecting a preliminary degreasing treatment on the coating subject article B with the degreasing agent solution L prior to the degreasing treatment at the main degreasing section 2B.

On the other hand, according to the inventive arrangement described above, a degreasing treatment can be done in an effective manner in association with the preliminary cleansing treatment of this article in the preliminary cleansing section. Thus, with omission of such preliminary degreasing section, the coating subject article after its treatment in the preliminary cleansing section is subjected directly to the degreasing treatment in the dipping type main degreasing section.

Therefore, according to this inventive arrangement, thanks to the omission of the preliminary degreasing section, the facility can be made further smaller and also such additional accessory devices, e.g. a pump, etc., accompanying the preliminary degreasing section can be omitted also, thus making even further reduction in the initial cost and the running cost of the facility.

A third characterizing feature of the invention specifies a preferred embodiment for embodying the first or second characterizing feature. According to this third characterizing feature:

an iron dust removing device is provided for removing iron dust contained in the preliminary cleansing water used in the preliminary cleansing of the coating subject article in the preliminary cleansing section by separating the iron dust from the preliminary cleansing water by a specific weight difference therebetween; and a degassing means is provided for removing bubbles contained in the preliminary cleansing water to be sent to the iron dust removing device.

With the above arrangement, iron dust which may be contained in the preliminary cleansing water used in the preliminary cleansing of the coating subject article (i.e. iron dust removed from the coating subject article in the preliminary cleansing treatment) is separated and removed from this preliminary cleansing water by the iron dust removing device. However, as this iron dust removing device is configured to separate such iron dust from the preliminary cleansing water based on a specific weight difference between the preliminary cleansing water and the iron dust, in case the preliminary cleansing water contains bubbles such as the microbubbles, such bubbles (in particular larger bubbles) will adhere to the iron dust, The buoyancy of these bubbles causes decrease in the apparent weight of the iron dust, thus inviting deterioration in the iron dust removing function of the iron dust removing device.

On the other hand, according to the above-described inventive arrangement, a degassing means is provided for removing bubbles contained in the preliminary cleansing water to be sent to the iron dust removing device. As a result, even with the designed inclusion of microbubbles in the preliminary cleansing water, thanks to removal of bubbles by this degassing means, the iron dust separating function of the iron dust removing device can be maintained high.

A fourth characterizing feature of the invention specifies a preferred embodiment for embodying any one of the first through third characterizing features. According to this fourth characterizing feature:

the flushing section includes a collection tank for collecting the cleansing water used in the cleansing of the coating subject article and a spraying device for cleansing the coating subject article by spraying the cleansing water supplied from the collection tank via a water supplying passage;

the microbubble generator device is arranged to supply the microbubbles to the cleansing water present in either the water supplying passage or the collection tank;

the preliminary cleansing water supplying passage is arranged to supply the cleansing water in the collection tank to the preliminary cleansing section as the preliminary cleansing water; and a cleansing water supplying passage is provided for supplementing new cleansing water to the collection tank.

With this arrangement, in the flushing section, the cleansing water used for cleansing of the coating subject article by spraying from the spraying device is collected in the collection tank, so that the coating subject article after the degreasing treatment is cleansed by circulating the cleansing water in the order of: collection tank-water supplying passage-spraying device-coating subject article-collection tank.

Further, in association with this cleansing water circulation, the cleansing water in the collection tank is supplied as the preliminary cleansing water to the preliminary cleansing section via the preliminary cleansing water supplying passage and for this, a flow amount of the cleansing water corresponding to the supplied amount is replenished to the collection tank via the cleansing water supplying passage.

And, in this mode of operation in the flushing section, with supplying of microbubbles by the microbubble generator device to the cleansing water in the water supplying passage or the collection tank, the cleansing water to be supplied from the collection tank to the preliminary cleansing section as the preliminary cleansing water (i.e. the preliminary cleansing water for use in the preliminary cleansing of the coating subject article in the preliminary cleansing section) is caused to contain microbubbles.

And, in this arrangement, as microbubbles are supplied by the microbubble generator device to the cleansing water in the water supplying passage or the collection tank, in association with the inclusion of these microbubbles in the cleansing water supplied as the preliminary cleansing water from the collection tank to the preliminary cleansing section, the microbubbles can be contained also in the cleansing water to be sprayed by the spraying device to the coating subject article in the flushing section. With this, the treatment effect of the cleansing treatment on the coating subject article in the flushing section can also be enhanced by the microbubbles.

EMBODIMENTS

Figure 1:
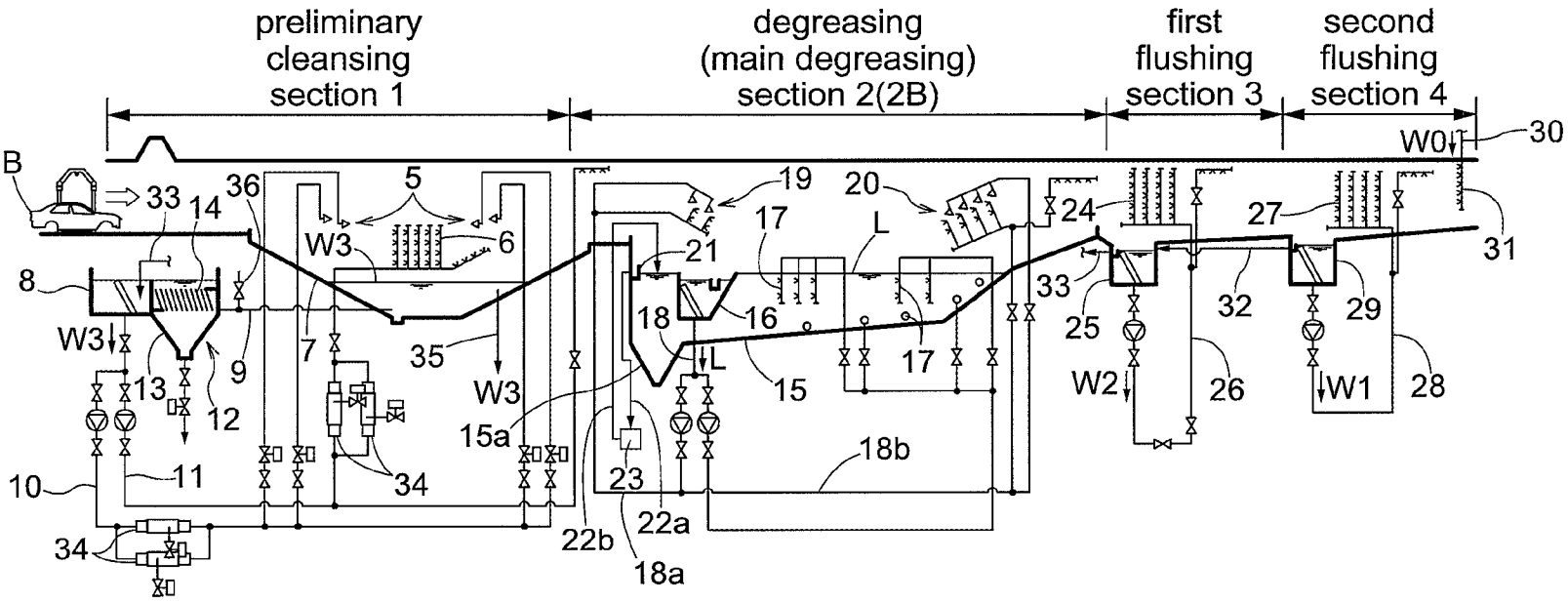
FIG. 1 is a diagram of a facility configuration showing a part of a coating pretreatment facility.

FIG. 1 shows a part of a coating pretreatment facility. In this coating pretreatment facility, a coating subject article B prior to its coating (in this case, an automobile body) is sent respectively to a preliminary cleansing section 1, a degreasing section 2, a first flushing section 3 and a second flushing section 4 in this mentioned order to be subject to coating pretreatments in the respective sections. Subsequently, the coating subject article B is sent also to a surface adjustment section, a chemical treatment section, a post chemical treatment flushing section, and a pure water flushing section in this mentioned order to be subjected to further coating pretreatments therein and then sent eventually to a coating step.

In the preliminary cleansing section 1, there are provided a water jetting device 5 for preliminary cleansing in which preliminary cleansing water W3 is sprayed in the form of a jet flow onto the coating subject article B, and a spraying device 6 for spraying the preliminary cleansing water W3 onto the coating subject article B. Then, in this preliminary cleansing section 1 in operation, preliminary cleansing of the pre-coating subject article B is effected by jetting or spraying of the preliminary cleansing water W3 by these water jetting device 5 and spraying device 6, whereby dust such as iron dust adhering to the coating subject article B is removed.

Further, in the preliminary cleansing section 1, there is provided a collection tank 7 for collecting an amount of the preliminary cleansing water W3 which has been used for the preliminary cleansing of the coating subject article B. To the bottom of this collection tank 7, there is connected a water guiding passage 9 for guiding collected preliminary cleansing water W3 to a water service tank 8, so that to the water jetting device 5 and the spraying device 6, the preliminary cleansing water W3 is supplied from this water service tank 8 via water supplying passages 10, 11.

On the exit side of the water guiding passage 9, an iron dust removing device 12 is disposed. This iron dust removing device 12 is arranged to remove iron dust contained in the preliminary cleansing water W3 collected in the collection tank 7 by separating it from the preliminary cleansing water W3 based on a specific weight difference between the preliminary cleansing water W3 and the iron dust and to introduce the resultant preliminary cleansing water W3 after the removal of iron dust therefrom into the water service tank 8.

Namely, in the preliminary cleansing section 1, a portion of the preliminary cleansing water W3 which has been used in the preliminary cleansing of the coating subject article B is circulated to in the order of collection tank 7—water guiding passage 9—iron dust removing device 12—water service tank 8—water supplying passages 10, 11—water jetting device 5—spraying device 6 for its use respectively therein.

In the iron dust removing device 12, more particularly, the preliminary cleansing water W3 introduced from the water guiding passage 9 to a casing tank 13 is caused to pass in subdivided portions through many inclined flow passages 14 obliquely upwards, and in the course of this passage, iron dust present in the preliminary cleansing water W3 will be precipitated onto inclined bottom walls of the respective inclined flow passages 14, whereby the iron dust is removed from the preliminary cleansing water W3.

The separated iron dust is caused to slide down the inclined bottom walls of the respective inclined flow passages 14 to be eventually deposited on the bottom top portion of the casing tank 13. Also, the iron dust removed preliminary cleansing water W3 is caused to flow into the water service tank 8 by overflowing thereof from the casing tank 13.

In the degreasing section 2, there is provided a degreasing tank 15 for reserving an amount of degreasing agent solution L. As the coating subject article B after its preliminary cleansing in the preliminary cleansing section 1 will be subjected to a degreasing treatment by being submerged in the degreasing agent solution L in the degreasing tank 15, whereby oil adhering to this coating subject article B will be chemically removed therefrom.

Further, in the degreasing section 2, there is also provided an auxiliary tank 16 into which the degreasing agent solution L in the degreasing tank L is caused to flow by overflowing therefrom. To the bottom portion of this auxiliary tank 16, there is connected a solution supplying passage 18 for supplying the degreasing agent solution L in the auxiliary tank 16 to nozzle devices 17 provided inside the degreasing tank 15.

Namely, as an amount of the degreasing agent solution L is jetted to from the nozzle devices 17 to the degreasing agent solution L present inside the degreasing tank 15, the degreasing agent solution L held in the degreasing tank 15 is agitated, so that the treatment effect of the degreasing treatment to the coating subject article B is enhanced by this agitation.

The degreasing agent solution L inside the auxiliary tank 16 is supplied also to solution spraying devices 19, 20 disposed at the inlet and the outlet of the degreasing tank 15 via branch solution supplying passages 18*a*, 18*b* branched from the solution supplying passage 18, so that the degreasing agent solution L will be sprayed onto the coating subject article B from these spraying devices 19, 20, too.

At an attached tank portion 15*a* provided at an end portion of the degreasing tank 15, there is provided an oil collection ditch 21 for causing oil floating on the liquid surface of the degreasing agent solution L in the tank (namely, the oil removed from the coating subject article B by the degreasing treatment in the degreasing tank 15) is caused to be introduced therein by overflowing. And, the oil and the amount of the degreasing agent solution L which have been introduced in this oil collection ditch 21 will be sent via a collection passage 22*a* to an oil removing device 23.

And, in the oil removing device 23, oil is separated from a mixed fluid consisting of the oil sent via the collection passage 22*a* and the degreasing agent solution L and the separated oil is collected in a collection container, and also the degreasing agent solution L from which the oil has been removed is sent back to the attached tank portion 15*a* of the degreasing tank 15 via a solution returning passage 22*b*.

Figure 5:
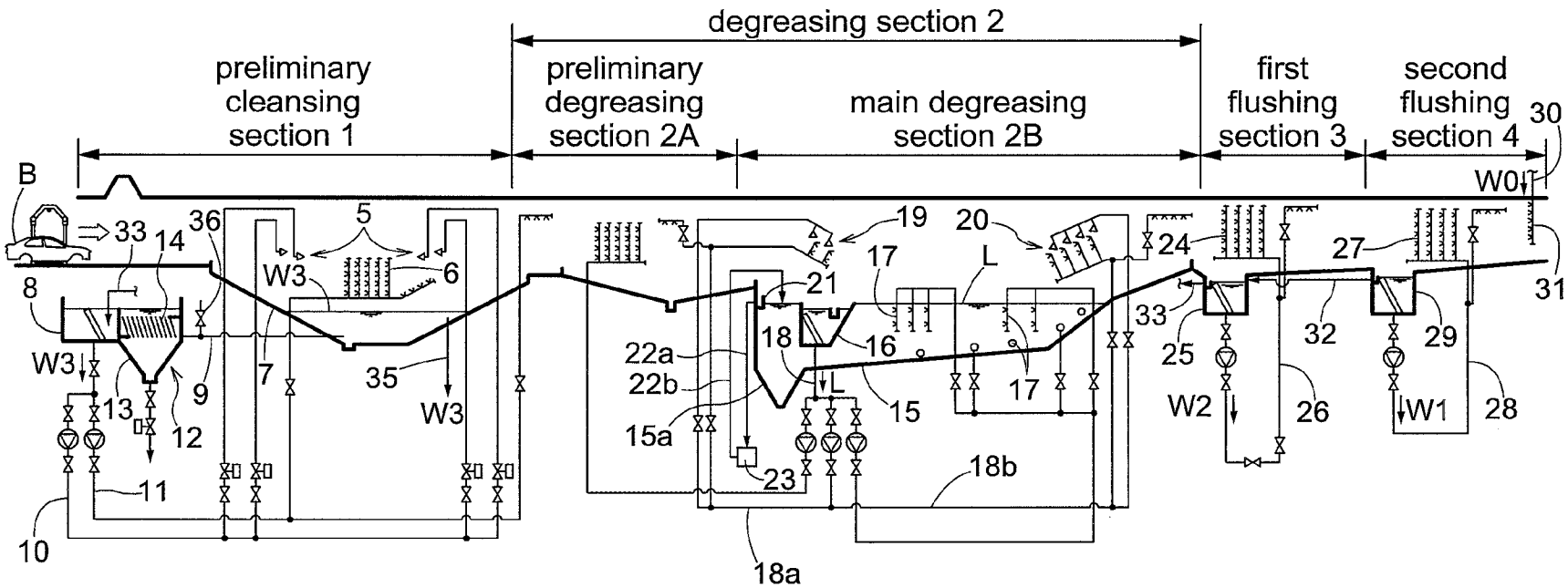
FIG. 5 is a view showing a conventional degreasing section.

Incidentally, in the case of a conventional standard coating pretreatment facility, as shown in FIG. 5, there are provided a dipping (submerging) type main degreasing section 2B arranged to effect a degreasing treatment by submerging the coating subject article B in the degreasing agent solution L held in the degreasing tank 15 as described above and also a preliminary degreasing section 2A of e.g. a spraying type, for effecting a preliminary degreasing treatment on the coating subject article B by the degreasing agent solution L, prior to the degreasing treatment at the main degreasing section 2B. However, in the case of the coating pretreatment facility of this embodiment, the preliminary degreasing section 2A is not provided, and the dipping type main degreasing section 2B alone is provided as the degreasing section 2.

In the first flushing section 3, there is provided a first flushing spraying device 24 for spraying cleansing water W2 onto the coating subject article B after the degreasing treatment. In this first flushing section 3 in operation, the coating subject article B is cleansed by spraying of the cleansing water W2 by the spraying device 24, whereby any amount of degreasing agent solution L remaining on the degreased coating subject article B will be removed therefrom.

Further, in the first flushing section 3, there is also provided a collection tank 25 for collecting the cleansing water W2 used in the cleansing of the coating subject article B. To the spraying device 24, the cleansing water W2 collected in the collection tank 25 will be supplied via a water supplying passage 26.

In the second flushing section 4, there is provided a second flushing spraying device 27 for flushing away any amount of degreasing agent solution L remaining on the coating subject article B by spraying cleansing water W1 onto the coating subject article B. And, there is also provided a collection tank 29 for collecting the cleansing water W1 used in the cleansing of the coating subject article B and supplying this collected cleansing water W1 to the spraying device 27 via a water supplying passage 28.

In the second flushing section 4, there is also provided a finishing spraying device 31 for spraying an amount of new cleansing water W0 (e.g. industrial water) fed from a cleansing water supplying passage 30, subsequently to the spraying of the cleansing water W1 by the spraying device 27. So that, as a finishing cleansing on the coating subject article B after the degreasing treatment, this coating subject article B will be cleansed by spraying of the new cleansing water W0 by the spraying device 31, as a final cleansing treatment on the degreased coating subject article B.

An arrangement is provided such that the new cleansing water W0 used in the cleansing of the coating subject article B by its spraying from the finishing spraying device 31 will be collected in the collection tank 29 of the second flushing section 4 together with the cleansing water W1 used in the cleansing of the coating subject article B by the spraying thereof from the spraying device 27 in the preceding stage. With this arrangement, in the second flushing section 4, the new cleansing water W0 used in the cleansing of the coating subject article B by the spraying thereof from the finishing spraying device 31 may be utilized as the cleansing water W1 to be sprayed from the spraying device 27 of the preceding stage.

Further, the collection tank 29 of the second flushing section 4 and the collection tank 25 of the first flushing section 3 are connected to each other via a cleansing water connecting passage 32 for sending an amount of the cleansing water W1 present in excess in the collection tank 29 of the second flushing section 4 to the collection tank 25 of the first flushing section 3. With this, in the first flushing section 3, the cleansing water W1 used in the cleansing of the coating subject article B in the second flushing section 4 may be utilized as the cleansing water W2 to be sprayed from the spraying device 24 of the first flushing section 3.

Moreover, in the coating pretreatment facility of this embodiment, the collection tank 25 of the first flushing section 3 and the water service tank 8 of the preliminary cleansing section 1 are connected to each other via a preliminary cleansing water supplying passage 33 for sending an amount of the cleansing water W1 present in excess in the collection tank 25 of the first flushing section 3 to the water service tank 8 of the preliminary cleansing section 1. With this, in the preliminary cleansing section 1, the cleansing water W2 used in the cleansing of the coating subject article B in the first flushing section 3 may be utilized as the preliminary cleansing water W3 to be sprayed from the water jetting device 5 and the spraying device 6 of the preliminary cleansing section 1.

And, water supplying passages 10, 11 for supplying the preliminary cleansing water W3 of the water service tank 8 to the water jetting device 5 and the spraying device 6 in the preliminary cleansing section 1 (namely, the cleansing water W2 used in the cleansing of the coating subject article B in the first flushing section 3) respectively incorporates a microbubble generator device 34 for supplying microbubbles to the preliminary cleansing water W3 passing through these water supplying passages 10, 11.

Namely, in the cleansing water W2 which has been used in the cleansing of the coating subject article B in the first flushing section 3, there are contained the amounts of degreasing agent solution L flushed off the coating subject article B in the second and first flushing sections 4, 3 respectively. So, in the preliminary cleansing section 1, by effecting preliminary cleansing of the coating subject article B with using such cleansing water W2 used in the cleansing of the coating subject article B in the first flushing section 3 as the preliminary cleansing water W3 and also by causing this preliminary cleansing water W3 to contain the microbubbles by the microbubble generator device 34, in the preliminary cleansing section 1, in association with the preliminary cleansing treatment on the coating subject article B, the degreasing treatment prior to the degreasing treatment in the degreasing section 2 may be provided to the coating subject article B, with its treatment effect enhanced by the microbubbles.

And, by effecting the prior degreasing treatment to the coating subject article B in the preliminary cleansing section 1 as described above, the degreasing section 2 needs to include only the dipping type main degreasing section 2B for submerging the coating subject article B in the degreasing agent solution L held in the degreasing tank 15, thus eliminating need to provide the dedicated preliminary degreasing section 2A described above in the degreasing section 2.

Further, to the collection tank 7 of the preliminary cleansing section 1, there is connected a water draining passage 35 for discharging an amount of the preliminary cleansing water W3 corresponding to the supplying amount of the cleansing water W2 supplied to the water service tank 8 as the preliminary cleansing water W3 through the preliminary cleansing water supplying passage 33 to the outside. This arrangement serves to prevent the oil removed from the coating subject article B by the degreasing treatment in the preliminary cleansing section 1 from being accumulated in the collection tank 7, thus eliminating provision of an oil removing device for the preliminary cleansing section 1.

Moreover, the water guiding passage 9 for guiding the preliminary cleansing water W3 collected in the collection tank 7 in the preliminary cleansing section 1 to the iron dust removing device 12 incorporates an air vent valve 36 as a "degassing means". With this, bubbles such as the microbubbles contained in the collected preliminary cleansing water W3 are removed from the preliminary cleansing water W3 to be sent to the iron dust removing device 12, thus preventing deterioration in the function of the iron dust removing device 12 due to the bubbles.

Incidentally, the inclusion of microbubbles in the preliminary cleansing water W3 to be sprayed onto the coating subject article B from the jetting device 5 in the preliminary cleansing section 1 serves mainly to enhance the degreasing effect for the coating subject article B due to the adhesive property of the microbubbles to the hydrophobic group of oil adhering to the coating subject article B. Also, the inclusion of microbubbles in the preliminary cleansing water W3 to be sprayed onto the coating subject article B from the spraying device 6 in the preliminary cleansing section 1 serves mainly to enhance the degreasing effect for the coating subject article B via the impulse (shock) waves discharged at time of bursting of the microbubbles in the sprayed preliminary cleansing water W3.

Further Embodiments

Figure 2:
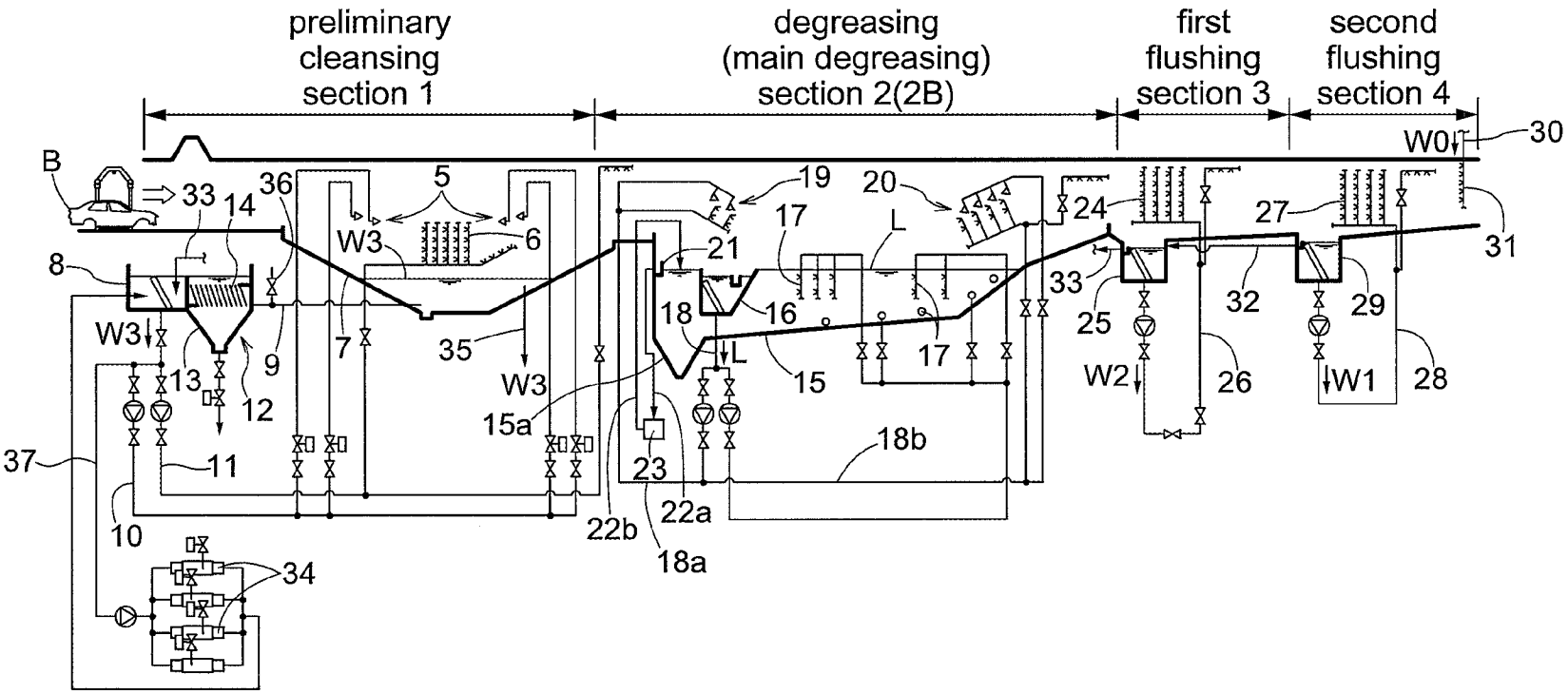
FIG. 2 is a facility configuration diagram showing a further embodiment.

The microbubble generator device 34 for causing the preliminary cleansing water W3 used in the preliminary cleansing of the coating subject article B in the preliminary cleansing section 1 to contain the microbubbles may be incorporated in a circulation passage 37 of the preliminary cleansing water W3 for the water service tank 8 of the preliminary cleansing section 1, as shown in FIG. 2.

Figure 3:
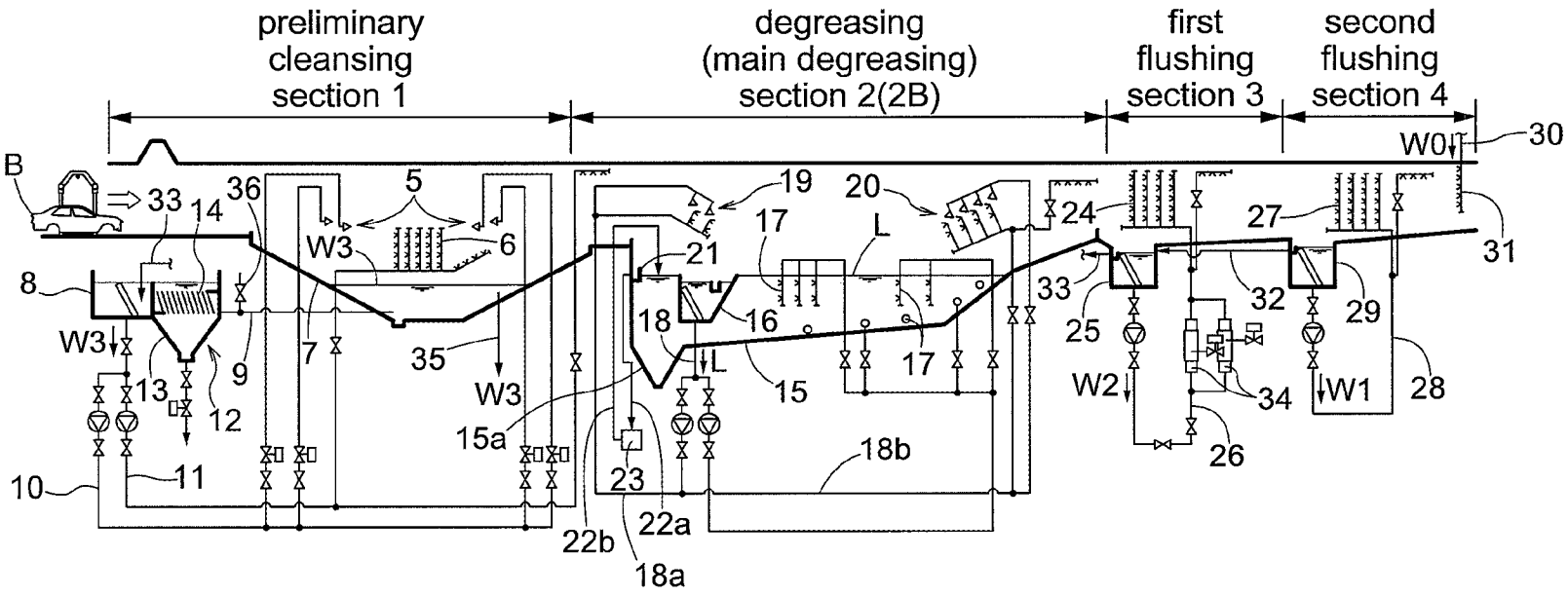
FIG. 3 is a facility configuration diagram showing a further embodiment.
Figure 4:
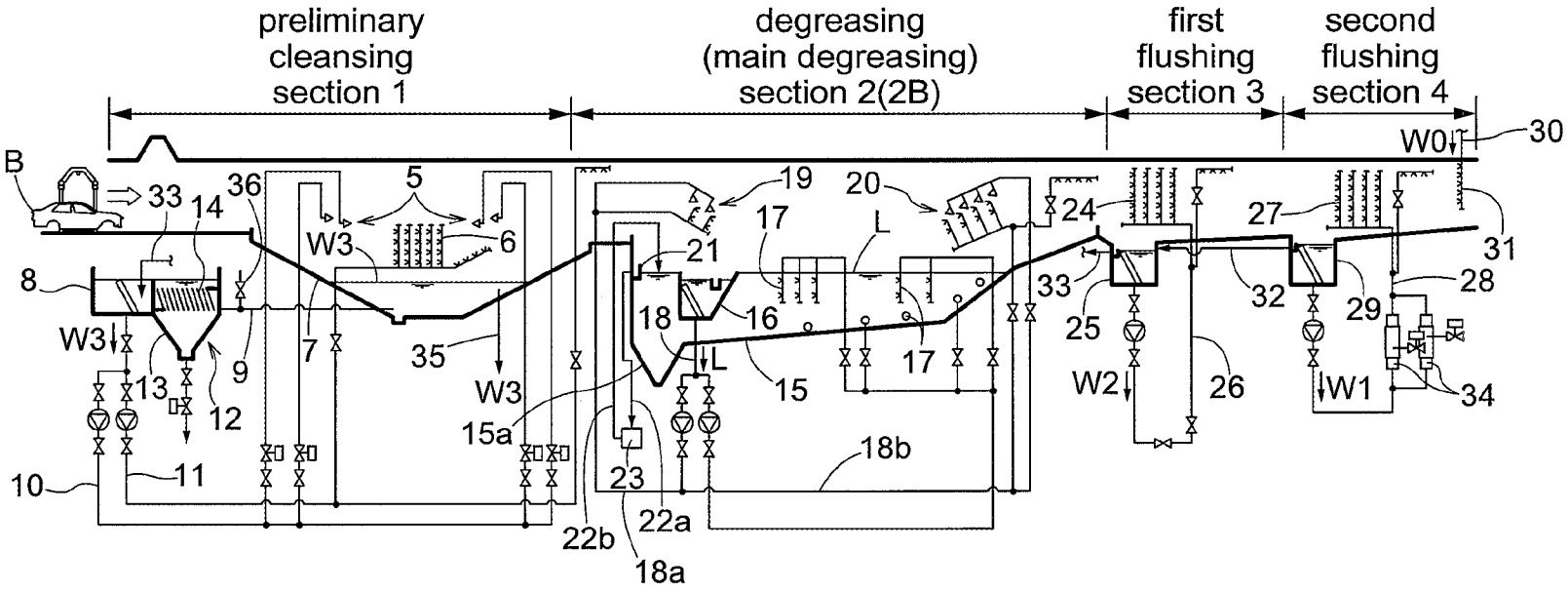
FIG. 4 is a facility configuration diagram showing a further embodiment.

Further alternatively, such microbubble generator device 34 may be incorporated in the water supplying passage 26 of the first flushing section 3 as shown in FIG. 3 or may be incorporated in the water supplying passage 28 of the second flushing section 4, as shown in FIG. 4.

In addition to the provision of the microbubble generator device 34 for causing the preliminary cleansing water W3 used in the preliminary cleansing of the coating subject article B in the preliminary cleansing section 1 to contain microbubbles, there may be provided a further microbubble generator device for causing the degreasing agent solution L held in the degreasing tank 15 to contain microbubbles.

An amount of new degreasing agent solution L may be supplied in a supplementary manner to the preliminary cleansing water W3 used in the preliminary cleansing of the coating subject article B in the preliminary cleansing section 1.

INDUSTRIAL APPLICABILITY

The present invention is applicable not only to the coating pretreatment of an automobile body, but also to coating pretreatments of various kinds of coating subject articles in various fields.

DESCRIPTION OF REFERENCE MARKS/NUMERALS

B: coating subject article
W3: preliminary cleansing water
1: preliminary cleansing section
L: degreasing agent solution
2: degreasing section
W2, W1: cleansing water
3: first flushing section (flushing section)
4: second flushing section (flushing section)
33: preliminary cleansing water supplying passage
34: microbubble generator device
15: degreasing tank
2B: dipping type main degreasing section
2A: preliminary degreasing section
12: iron dust removing device
36: air vent valve (degassing means)
25, 29: collection tank
26, 28: water supplying passage
24, 27: spraying device
W0: new cleansing water
30: cleansing water supplying passage

The invention claimed is:

1. A coating pretreatment facility comprising:

a preliminary cleansing section for preliminarily cleansing a coating subject article prior to its coating with preliminary cleansing water;

a degreasing section for effecting a chemical degreasing treatment on the coating subject article preliminarily cleansed by the preliminary cleansing section with degreasing agent solution; and a flushing section for flushing the coating subject article degreased by the degreasing section with cleansing water;

wherein a preliminary cleansing water supplying passage is provided for supplying the cleansing water used in the flushing of the coating subject article in the flushing section to the preliminary cleansing section as the preliminary cleansing water for use in the preliminary cleansing in this preliminary cleansing section; and a microbubble generator device is provided for causing the preliminary cleansing water for use in the preliminary cleansing in the preliminary cleansing section to contain microbubbles, the preliminary cleansing section includes devices for preliminary cleansing, a collection tank, and a water service tank, the devices for preliminary cleansing effect preliminary cleansing of the coating subject article using the preliminary cleansing water, the collection tank collects the preliminary cleansing water used in the preliminary cleansing of the coating subject article, as the collection tank collects the preliminary cleansing water used in the preliminary cleansing of the coating subject article, the preliminary cleansing water collected in the collection tank is guided via a water guiding passage to the water service tank, and the cleansing water used in the flushing of the coating subject article in the flushing section is supplied as the preliminary cleansing water via the preliminary cleansing water supplying passage to the water service tank, the devices for preliminary cleansing are supplied with the preliminary cleansing water from the water service tank via water supplying passages, the water service tank is provided with a circulation passage, concurrently with the circulation of the preliminary cleansing water via the collection tank, the water guiding passage, the water service tank, the water supplying passages, and the devices for preliminary cleansing, in this order, the preliminary cleansing water is returned from the water service tank to the water service tank via the circulation passage in a short-circuit manner, and the microbubble generator device is incorporated in the circulation passage and causes the preliminary cleansing water flowing the circulation passage to contain the microbubbles.

2. The coating pretreatment facility of claim 1, wherein:

the degreasing section includes only a dipping type main degreasing section for submerging the coating subject article in the degreasing agent solution held in the degreasing tank; and the degreasing section precludes a preliminary degreasing section for effecting preliminary degreasing treatment on the coating subject article prior to the degreasing treatment at the dipping type main degreasing section.

3. The coating pretreatment facility of claim 1, wherein:

an iron dust removing device is provided for removing iron dust contained in the preliminary cleansing water used in the preliminary cleansing of the coating subject article in the preliminary cleansing section by separating the iron dust from the preliminary cleansing water by a specific weight difference therebetween; and a degassing means is provided for removing bubbles contained in the preliminary cleansing water to be sent to the iron dust removing device.

4. The coating pretreatment facility of claim 3, wherein:

the iron dust removing device is incorporated in the water guiding passage, and an air vent valve as the degassing means is provided to the water guiding passage upstream of the iron dust removing device in a flow direction of the preliminary cleansing water.

5. The coating pretreatment facility of claim 4, wherein:

the preliminary cleansing section is provided with, as the devices for preliminary cleaning: a jetting device, in which the preliminary cleansing water is sprayed in the form of a jet flow onto the coating subject article, and a spraying device in which the preliminary cleansing water is sprayed onto the coating subject article, the jetting device is supplied with the preliminary cleansing water containing the microbubbles from the water service tank via the water supply passage, and the spraying device is supplied with the preliminary cleansing water containing the microbubbles from the water service tank via the water supplying passage.

6. The coating pretreatment facility of claim 3, wherein:

the preliminary cleansing section is provided with, as the devices for preliminary cleaning: a jetting device, in which the preliminary cleansing water is sprayed in the form of a jet flow onto the coating subject article, and a spraying device in which the preliminary cleansing water is sprayed onto the coating subject article, the jetting device is supplied with the preliminary cleansing water containing the microbubbles from the water service tank via the water supply passage, and the spraying device is supplied with the preliminary cleansing water containing the microbubbles from the water service tank via the water supplying passage.

7. The coating pretreatment facility of claim 1, wherein:

the preliminary cleansing section is provided with, as the devices for preliminary cleaning: a jetting device, in which the preliminary cleansing water is sprayed in the form of a jet flow onto the coating subject article, and a spraying device in which the preliminary cleansing water is sprayed onto the coating subject article, the jetting device is supplied with the preliminary cleansing water containing the microbubbles from the water service tank via the water supply passage, and the spraying device is supplied with the preliminary cleansing water containing the microbubbles from the water service tank via the water supplying passage.

* * * * *